United States Patent [19]

Kutz et al.

[11] Patent Number: 4,878,365

[45] Date of Patent: Nov. 7, 1989

[54] APPARATUS FOR CONTINUOUS TREATMENT OF A TEXTILE WEB

[75] Inventors: Johannes Kutz, Tönisvorst; Günter von Harten, Kaarst, both of Fed. Rep. of Germany

[73] Assignee: Eduard Küsters Maschinenfabrik GmbH & Co. KG, Krefeld, Fed. Rep. of Germany

[21] Appl. No.: 255,611

[22] Filed: Oct. 11, 1988

[30] Foreign Application Priority Data

Oct. 8, 1987 [DE] Fed. Rep. of Germany ..... 3733997

[51] Int. Cl.[4] ..... D06B 3/18; D06B 21/00

[52] U.S. Cl. ..... 68/9; 68/21; 68/22 R; 68/175

[58] Field of Search ..... 68/9, 21, 22 R, 22 B, 68/43, 175

[56] References Cited

U.S. PATENT DOCUMENTS

| | | | |
|---|---|---|---|
| 521,816 | 6/1894 | Reffitt | 68/9 X |
| 1,979,818 | 11/1934 | Baker | 68/9 X |
| 2,784,583 | 3/1957 | Dungler | 68/22 B X |
| 3,255,617 | 6/1966 | Bisang | 68/175 |
| 4,193,762 | 3/1980 | Namboodri | 68/175 X |
| 4,202,774 | 5/1980 | Kos . | |

FOREIGN PATENT DOCUMENTS

| | | |
|---|---|---|
| 1078527 | 3/1960 | Fed. Rep. of Germany . |
| 2036520 | 2/1972 | Fed. Rep. of Germany . |
| 1381081 | 10/1964 | France . |
| 2426495 | 12/1979 | France . |

OTHER PUBLICATIONS

"Apparatus for Supplying Liquid to an Elongated Liquid Reservoir" (Copending application) Ser. No. 255,987, German Pat. No. 2036520–Abstract from WPI database.

*Primary Examiner*—Philip R. Coe

*Attorney, Agent, or Firm*—Kenyon & Kenyon

[57] ABSTRACT

A method and apparatus for the continuous treatment of a textile web is disclosed. The apparatus comprises a foulard in which the textile web is provided with a first treatment bath and squeezed off to a moisture content of 60 to 100%. The web then is conducted to a gore applicator in which the web is provided with a second bath application of 40 to 100%. The second application occurs in an upright vat in which the textile web is always in contact with only a very small quantity of continually replenished treatment bath. The vat is sealed at a bottom gap by two mutually opposing inflatable hoses with one hose disposed on each side of the textile web. The hoses sealingly abut against the web and wipe off treatment bath entrained by the web to a predetermined total moisture content. In the dyeing process, the web subsequently runs into a steam apparatus and then into a washing apparatus.

8 Claims, 1 Drawing Sheet

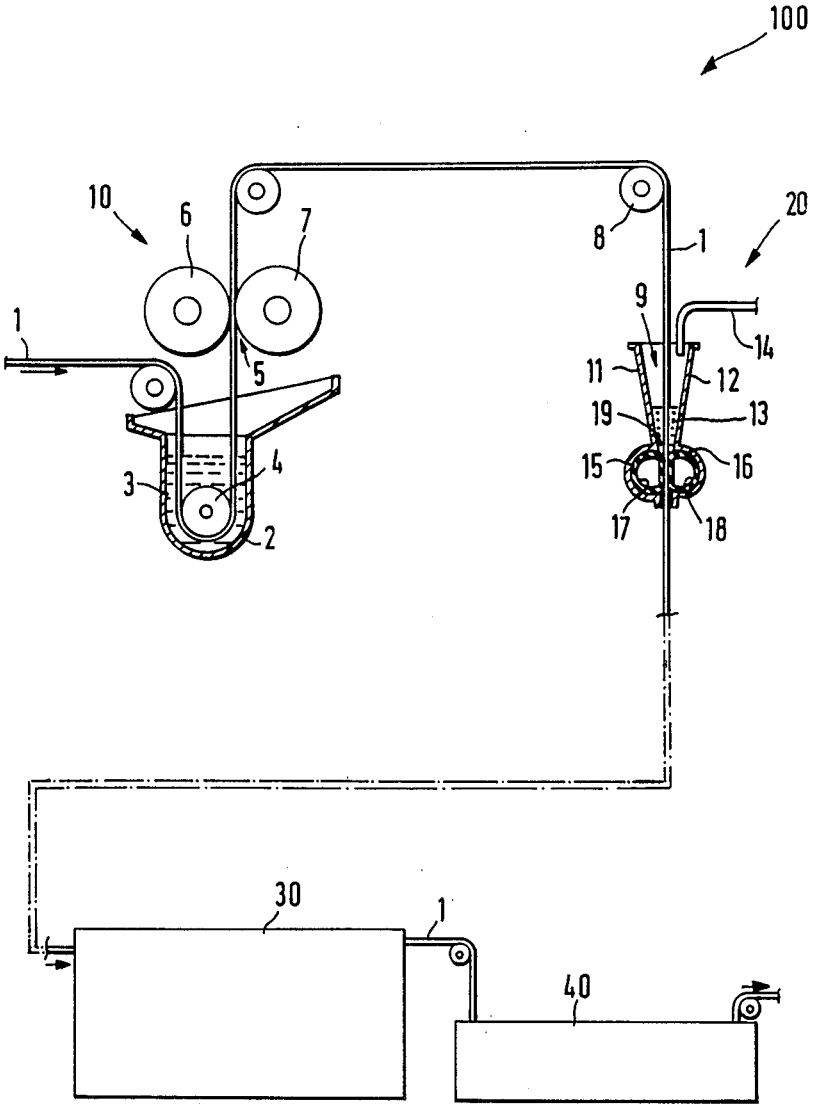
100
10
6
7
8
1
20
9
14
1
5
11
12
19
13
15
16
3
4
17
18
2
30
1
40

APPARATUS FOR CONTINUOUS TREATMENT OF A TEXTILE WEB

BACKGROUND OF THE INVENTION

The invention relates generally to a process and apparatus for the treatment of textile webs and more particularly to a continuous process and apparatus for treating a textile web by the wet-in-wet application of two interacting treatment baths.

The invention is generally directed to the problems which have long existed in continuous dyeing process with direct dyes (also referred to in German as Substantiv-Farbstoffen). For example, see Fischer-Bobsien, "International Lexikon Textilveredlung+Grenzgebiete", 4th edition 1975, columns 419–422. The dye bath of such a process is applied in a foulard applicator with the textile web being passed through the relatively large quantity of dye liquid contained in the trough of the foulard. One of the problems with this process is the end waste runs that inevitably occur due to nonuniform treatment of the web both at the beginning and at the end of the textile web. As the first portion of the web passes through the bath, absorption by the textile web causes a corresponding depletion of the bath, which must be readjusted It takes some time before an equilibrium is established and the concentration of the bath remains constant. Until this state is reached, the web is still running through the bath and an end waste run of typically 50 to 150 m has taken place. An end waste run is a length of fabric of different and in particular nonuniform color that cannot be used together with the rest of the fabric. Therefore end waste runs are sold as inferior qualities or are black overdyes. In any event end waste runs result in some loss that heretofore has not been avoidable.

Another problem with this process is that the direct dyes are not completely absorbed and the dye that is not fixed on the textile web is washed out after the steaming process. The dye yield, i.e., the ratio of the amount of dye actually fixed on the fabric to the amount of dye originally applied, is far from 100% (ideal), but rather is on order of about 60%. The unabsorbed 40% of the dye is washed "down the drain" and constitutes not only a quite considerable cost factor, but also a difficult environmental problem. The environmental problem can be severe because molecules of direct dyes contain complex-bound heavy metal ions, in particular copper ions, which are regarded as a dangerous sewage poison and are the subject of strict government regulations that must be obeyed.

It is known that the absorption of direct dyes on a fabric web generally can be improved by addition of salts, such as common salt or Glauber's salt (sodium sulfate). In this manner, the proportion of dye actually absorbed by the fibers can be increased and thus the dye loss and the pollution is reduced. However, in the continuous dyeing process, the addition of salt to the dye bath in the foulard has been found to lead to an intensification of the end waste run problem. The salt increases the absorptive capacity of the fabric such that the web rapidly takes up dye from the bath and the bath exhibits, at the beginning and toward the end of the web still stronger concentration variations that are difficult to control. Thus, it has been thought that the addition of salt, proven per se as a means for improving the dye yield and the pollution, cannot readily be employed in continuous dyeing processes.

The invention is specifically directed to the problem of providing a continuous dyeing process and apparatus for treating a textile web by the wet-in-wet application of two treatment baths such that the interaction of the two treatment baths occurs in a controlled manner, no variations in treatment result from changes in concentration of the second treatment bath and a uniform treatment over the length of the textile web is achieved.

SUMMARY OF THE INVENTION

The invention solves this problem by providing a continuous process for treating a web of material by the wet-in-wet application of two interacting treatment baths comprising the steps of (a) applying a first treatment bath to the web, (b) squeezing off excess moisture from the web to a moisture content of 60 to 120%, (c) applying a second treatment bath to the web while it is still wet from the first treatment bath such that the web is in contact with only a small amount of second treatment bath that is continually absorbed by the web and replenished, and (d) partially desiccating the web to a total moisture content of 100 to 200% immediately after application of the second treatment bath by wiping it off as it passes through a gap elastically abutting against at least one side of the web.

Primarily the process may be used for the treatment of flat fabrics. In the case of such a textile web, the first treatment bath may be applied in any manner and then squeezed off to a moisture content of 60 to 120%. The moisture content values herein refer to the quantity of treatment bath absorbed in relation to the dry weight of the textile web on which the treatment bath has been applied. A value of 120% generally is the upper limit when uniformly squeezing off treatment bath in a squeeze mechanism formed by cooperating rolls. To achieve higher moisture contents the squeezing mechanism would have to be run at such low linear pressures that uniformity of extraction could no longer be ensured and there would even be a danger of liftoff of the rolls. On the other hand, such a high quantity of moisture could not be applied on a textile web at an acceptable cost other than by impregnation or wetting of the textile web and subsequent squeezing. Spraying the web is difficult to carry out uniformly, as is pouring bath onto the web because the quantity of liquid is too small for the formation of a uniform film.

According to the invention, the second treatment bath is applied on the textile web in a special manner, with the web still wet from the liquid applied from the first bath. The textile web must not be passed through a relatively large supply of bath because of the danger of variations in concentration due to treatment medium being entrained out of the textile web. Therefore, according to the invention the textile web is in contact with only as small an amount of bath as possible. The second bath is very quickly absorbed by the web and transported away. Accordingly, the second bath is continuously replenished by introduction of fresh treatment bath. Thus, a fresh supply of the second bath is applied onto the textile web such that the major lengths of the web are presented with a fresh supply. In this manner changes in concentration of the amount of the second treatment bath in contact with the textile web and accordingly, variation in the application treatment, are minimized.

In the process of the invention, it is also important that squeezing off between rollers does not take place after application of the second treatment bath because with roll squeezing mechanisms it is not possible to uniformly establish a total moisture content substantially above 120%. If squeezing was performed after application of the second treatment bath, it might at best be possible to add about 10% of the second treatment bath. In many cases, this is too little for joint action of the two treatment baths and successful treatment. For this reason, after application of the second treatment bath the textile web is not squeezed off, but wiped off. In this manner about as much second treatment liquid can be added to the web as was added in the first application. The total moisture content attainable is within the range of the amount of moisture the web can hold without moisture dripping off the textile web or running down along it. Loading the web with bath at the limits of its drip-free moisture content is advantageous for many treatments because it results in increased water mobility on the textile web. Additionally, transport of the treatment medium between the two baths and in particular the absorption of the treatment medium from the total bath onto the fibers in the steaming step that generally follows application is facilitated.

A wet-in-wet application of a treatment liquor in two stages is, taken by itself, disclosed in DE-AS 10 78 527. However, in this patent the second application occurs in a gore applicator after which the web is squeezed off between rolls. The high liquid loads of the textile web required in the invention could not be obtained in such an apparatus without the liquid running through between the rolls and nonuniform treatment occurring.

A preferred example of the process of the invention is realized when the first treatment bath comprises a salt bath and the second treatment bath comprises a dye bath of direct dyes such that during step (b) above, the web is squeezed off to a moisture content of 70 to 90% and during step (d) above, the web is wiped off in the gap to a total moisture content of 130 to 160%.

It has been proven by extensive experiments that the end waste runs in the dyeing of cotton goods with direct dyes by the process of the invention can be brought down from typically 50 to 150 m of textile web length to typically 3 to 5 m and the dye yield increased by up to 40% such that the dye losses and the pollution of heavy metals in the waste water is reduced accordingly.

Additional examples of the process of the invention are realized when the first treatment bath comprises a salt bath and the second treatment bath comprises a dye bath of sulfur dyes such that during step (b) the web is squeezed off to a moisture content of 70 to 90% and during step (d) the web is wiped off in the gap to a total moisture content of 160 to 200% and when the first treatment bath comprises an alkali bath and the second treatment bath comprises a dye bath of reactive dyes such that during step b) the web is squeezed off to a moisture content of 70 to 100% and during step (d) the web is wiped off in the gap to a total moisture content of 160 to 200%. In the latter example, the first treatment bath may comprise a mixture of alkali and salt.

Especially in the case of reactive dyes the losses occurring heretofore have been so high that continuous processes were hardly carried out. With reactive dyes the temperature of the two applied treatment baths should be substantially equal to create optimum interaction with the textile web.

However, the invention is by no means limited to dye treatments of textile fabric webs. Rather, it is applicable to all instances in which bath separation according to the invention offers advantages, e.g., in bleaching processes. Nor is there any limitation with respect to the type of web that can be employed. Thus, a paper or similar web can be treated, in particular, dyed by the process of the invention.

According to another aspect of the invention an apparatus for carrying out the continuous treatment process of the invention comprises two applicators containing treatment baths that are serially arranged in the running direction of the textile web such that after the web absorbs treatment bath from the first applicator it passes into the second applicator. The first applicator applies a first treatment bath to the web of material, which is fed through a roll squeezing mechanism after passing through the first applicator A second applicator then applies a second treatment bath to the web such that both sides of the web is in contact with only a very small amount of the second treatment bath that is continually being replenished in proportion to the rate it is absorbed by the web. A gap extends across the width of the web through which the web is conducted after passing through the second applicator and a wiping device defining the gap comprises a flexible wall disposed on at least one side of the textile web in a zone extending across the width of the web. The flexible wall is inflatable by a fluid pressure medium to sealing abut against the web. The first applicator may comprise a foulard and the second applicator may comprise a gore applicator having mutually opposing walls with one wall disposed on each side of the web. The walls are joined outside the width of the web to form an upright vat extending across width of the web. The vat is fillable with second treatment bath to a predetermined filling level and defines at its lower end the gap through which the web passes vertically. The mutually opposing flexible walls define the gap and the walls may be formed by inflatable hoses.

Gore applicators of the stated type are disclosed, per se, in French patent No. FR-PS No. 13 81 081. However, the invention lies, not in the gore applicator itself, but in the combination of a first impregnation system with squeezing and a second impregnation system with a very small bath volume in which subsequent wiping off occurs such that a relatively large amount of bath is uniformly absorbed the textile web.

BRIEF DESCRIPTION OF THE DRAWINGS

The sole drawing FIGURE schematically illustrates an apparatus constructed according to the principles of the invention.

DETAILED DESCRIPTION

The apparatus 100 may be used, for example for dyeing a flat cotton web of fabric with direct dyes. The textile web 1 first is conducted through a foulard 10 that forms the first applicator 10. Applicator 10 comprises an immersion trough 2 which, given a textile web width of 1.80 m, contains 30 to 60 l of a salt bath 3 through which the web is passed, in the manner shown, over a guide roller 4. From there the web is then guided vertically upward and squeezed through the rolling gap or nip 5 formed between the squeezing rolls 6 and 7 to a moisture content of 70 to 90% of the area weight of the dry textile web 1.

After being loaded with the foregoing moisture content, the textile web 1 then is deflected vertically downward over a guide roll 8 and conducted into the gore applicator 20 that forms the second applicator. The gore applicator 20 comprises mutually opposing walls 11, 12 that surround both sides of the textile web 1. The walls 11, 12 are substantially planar in the illustrated embodiment and are slightly inclined relative to the textile web, i.e., the walls approach the web 1 in running direction of the web. At their distal ends, the walls 11, 12 are joined together outside the edges of the textile web 1 such that an upright, funnel type vat 9 is formed that can be filled with a treatment liquor 13 to a predetermined low filling level.

At the lower end of the vat 9, mutually opposing, elongated cutouts 15, 16 are formed to open toward the textile web 1 and extend across the width of the web. Inflatable pressure hoses 17, 18 are arranged inside cutouts 15, 16. When inflated, the hoses 17, 18 sealingly abut against the textile web from both sides with a gentle uniform pressure over the web width to close off the bottom of the vat 9. External of the edges of the textile web 1 the hoses 17, 18 directly abut against each other to seal the bottom of the vat outside the region of the width of the web. The textile web 1 is slidingly pulled through the gap 19 formed between the hoses 17, 18. In this process, the treatment bath 13 received in Vat 9, which may be a dye bath of direct dyes, is wiped off the web to produce a total web moisture content that is predetermined by the pressure in the hoses 17, 18. This total moisture content ranges from about 100 to 200%, i.e., in the second applicator 20 at least as much treatment bath is added to the web as had been applied previously during the first application.

The opposing sides of the hoses 17, 18 may be coated with a material to facilitate sliding. In this regard, especially successful results have been obtained with use of thin sliding sheets of corrosion-proof steel that can withstand the stresses cause by the bur or ridge found on the welded edges of the backs of carpeting.

The filling level in vat 9 is kept very low. For example, given a web width of 1.80 m and a corresponding width for vat 9, 4 to 8 lt of treatment bath 13 may be contained in vat 9. This quantity of bath would suffice for treatment of only a few meters of textile web 1 because it would be rapidly absorbed by the web. For this reason, the treatment bath 13 is continuously replenished by a feed system 14 that ensures a constant, though low filling level in vat 9. In this manner, a substantial changes in the concentration of the treatment bath 13 due to treatment medium being absorbed by the textile web 1 can not occur. Especially advantageous results can be obtained if the vat 9 is filled with a quantity of treatment bath 13 that is not greater than the amount of both absorbed by 30 m of the web.

Except for very small waste runs on the order of 3 to 5 m, the total length of the textile web 1 is dyed uniformly with the apparatus of the invention. The textile web 1, after treatment in applicator 20, may be conducted immediately into a steamer 30 and thereafter into a washing apparatus 40 having several compartments.

TEST EXAMPLES

1. Dyeing with direct dyes (a) A flat cotton web having a weight per area of 200 g/m$^2$ according to prior art in a foulard, without addition of salt, with the following dye bath and subsequently steamed in the steamer for 2 minutes:

| | |
|---|---|
| 3.0 ml/l | wetting agent |
| 2.0 ml/l | padding aid |
| 1.0 g/l | oxidant |
| 0.5 ml/l | deaerator |
| 7.7 g/l | Direct Blue I |
| 2.3 g/l | Direct Blue II |

The bath application was 85%, the working rate 30 m/min and the web width 1.8 m.

The result was a blue-dyed textile web that had end waste runs on the order of 100 m, which were unsuitable and had to be used in other ways.

(b) Next, a similar textile web was dyed to the same blue color in an apparatus constructed according to the invention with the addition of salt.

First, application of the following salt bath was effected in foulard 10:

| | |
|---|---|
| 3.0 ml/l | wetting agent |
| 3.0 ml/l | padding aid |
| 1.0 g/l | oxidant |
| 0.5 ml/l | deaerator |
| 30.0 g/l | common salt |

The salt bath was squeezed off the web until a web moisture content of 85% was reached.

The textile web 1 then Was immediately conducted into a gore applicator 20 of the invention containing a dye bath of the following composition:

| | |
|---|---|
| 2.0 ml/l | wetting agent |
| 4.2 g/l | Direct Blue I |
| 1.2 g/l | Direct Blue II |

The hoses 17, 18 were inflated to a pressure P=0.5 bar. This resulted in an additional bath application of 100% such that the total moisture content of the textile web 1 after the gore dyeing apparatus was 185%. Thereafter, the textile web 1 was steamed for 2 minutes and cold washed in the washing device 40 in six compartments With overflow. The same blue color as in Example 1a) was obtained, but the waste run was only 5 m. In addition, the dye process of Example 2a) was achieved with a smaller dye concentration, i.e., instead of, as in case Example 1a) 7.7+2.3=10 g/l dye, 4.2+1.2=5.4 g/l dye sufficed. With the addition of salt the absorption of the dye was enhanced such that a much greater proportion of the applied dye was actually absorbed on the fibers, or conversely, to obtain the same degree of color it was possible to use 37% less dye with the method and apparatus of the invention. Furthermore, the dye losses and the pollutants discharged into the sewage by the losses that would otherwise be washed out, in particular the heavy metal ions, were reduced accordingly. Thus, the invention achieves both a reduction in the amount of waste run of the web and an improvement in the amount of pollutants generated.

2. Dyeing with sulfur dyes (a) A flat cotton fabric web having a weight of 250 g/m$^2$ and a width of 1.8 m was treated according to prior art at a rate of 45 m/min in a foulard containing the following dye bath:

| | |
|---|---|
| 3.0 ml/l | wetting agent |
| 2.0 g/l | complex former |
| 14.6 g/l | Sulfur Black |
| 9.0 g/l | Sulfur Brown |
| 1.8 g/l | Sulfur Red |
| 20.0 g/l | Glucose |
| 35.0 ml/l | NaOH 29% |
| 3.0 ml/l | sodium borate |
| 3.0 ml/l | wetting agent |
| 0.5 ml/l | deaerator |

The web was squeezed off to a moisture content of 85%. After steaming and washing, the web had a gray coloration and an end waste run of 100 m was produced.

(b) A similar textile web 1 was treated in the foulard 10 of the invention with the following salt bath:

| | |
|---|---|
| 3.0 ml/l | wetting agent |
| 30.0 g/l | common salt |
| 0.5 ml/l | deaerator |

The web was squeezed off to a moisture content of 85%. The textile web 1 was then introduced into a gore applicator 20 of the invention containing the following dye bath:

| | |
|---|---|
| 2.0 g/l | complex former |
| 11.1 g/l | Sulfur Black |
| 6.8 g/l | Sulfur Brown |
| 1.4 g/l | Sulfur Red |
| 20.0 g/l | Glucose |
| 35.5 ml/l | NaOH 29% |
| 3.0 ml/l | sodium borate |
| 3.0 ml/l | Wetting agent |
| 0.4 ml/l | deaerator |

The bath application was 100% such that a total moisture content of the textile web 1 of 185% was produced. Thereafter, the textile web 1 entered the steamer 30 and washing then took place in the washing apparatus 40 in six compartments as follows:

1. 50° C. overflow
2. 70° C. overflow
3. 95° C. oxidizing 15 ml/l Textile aid
4. 95° C. oxidizing 1 g/l Soda
5. 50° C. overflow
6. cold overflow The result was a web having a gray coloration and a waste run of approximately 5 m. In the process according to Example 2a) the consumed quantity of Sulfur dyes was 25.4 g/l, while the process of the invention according to Example 2b) used only 19.3 g/l of Sulfur dyes, resulting in approximately 13% dye savings for the same degree of dying.

3. Bleaching

A cotton fabric web having a weight of 150 g/m$^2$ was provided on a foulard with the following bath:

| | |
|---|---|
| 6.0 g/l | NaOH solid, as alkali |
| 2.0 g/l | alkali-stable wetting agent |
| 6.0 g/l | organic stabilizer |
| 1.0 g/l | complex former |

The web was squeezed to a moisture content of 80%. The textile web 1 was then introduced into a gore applicator 20 and provided there additionally with an application of 80% of the following bleaching bath:

| | |
|---|---|
| 30.0 g/l | Na peroxide 35%. |

This process achieved very good bleaching results with good utilization of the treatment bath.

What is claimed is:

1. An apparatus for the continuous treatment of web of material wherein two applicators containing treatment baths are serially arranged in the running direction of the web such that after the web absorbs treatment bath from the first applicator the web is still wet as it passes into the second applicator, said apparatus comprising:

(a) a first applicator applying a first treatment bath to the web;

(b) a roll squeezing mechanism through which the web is fed after passing through the first applicator;

(c) a second applicator applying a second treatment bath to the web after it passes through the roll squeezing mechanism, with both sides of the web being in contact with only a very small amount of the second treatment bath, which is continually being replenished in proportion to the rate it is absorbed by the web;

(d) a gap extending across the width of the web through which the web is conducted after passing through the second applicator; and (e) a wiping device defining said gap comprising a flexible wall disposed on at least one side of the web in a zone extending across the width of the web, said flexible wall being inflatable by a fluid pressure medium to sealing abut against the web.

2. Apparatus according to claim 1 wherein said first applicator comprises a foulard.

3. Apparatus according to claim 2 wherein said second applicator comprises a gore applicator having mutually opposing walls with one wall disposed on each side of the web, said walls being joined outside the width of the web to form an upright vat extending across the width of web, said vat being fillable with the second treatment bath to a predetermined filling level and defining at its lower end the gap through which the web passes vertically.

4. Apparatus according to claim 3 wherein said gap comprises two mutually opposing flexible walls extending parallel to the sides of the web and inflatable against the textile web to sealingly abut against the web.

5. Apparatus according to claim 4 wherein said flexible walls are formed by inflatable hoses.

6. Apparatus according to claim 3 wherein said vat is filled with a quantity of second treatment bath that is not greater than the amount of second treatment bath absorbed by 30 m of the web.

7. Apparatus according to claim 1 wherein said second applicator comprises a gore applicator having mutually opposing walls with one wall disposed on each side of the web, said walls being joined outside the width of the web to form an upright vat extending across the width of web, said vat being fillable with the second treatment bath to a predetermined filling level and defining at its lower end the gap through which the web passes vertically.

8. Apparatus according to claim 1 wherein the web of material comprises a textile web.

* * * * *

UNITED STATES PATENT AND TRADEMARK OFFICE
CERTIFICATE OF CORRECTION

PATENT NO. : 4,878,365

DATED : November 7, 1989

INVENTOR(S) : Johannes Kutz et al

It is certified that error appears in the above-identified patent and that said Letters Patent is hereby corrected as shown below:

In Column 1, line 27, "must be readjusted It takes..."
should read --must be readjusted. It takes...-- column 4, line 18, "first applicator A second..."
should read --first applicator. A second ...--.

In Column 5, line 68, "...g/m$^2$ according to..." should
read --...g/m was treated according to...-- column 6, line 31, "The textile web 1 then Was..."
should read --The textile web 1 then was...-- line 46, "...With overflow." should read
--...with overflow.-- column 7, line 35, " 3.0 ml/l Wetting agent"
should read --3.0 ml/l wetting agent-- column 8, line 10, claim 1, "...treatment of web..."
should read --...treatment of a web...--

Signed and Sealed this

Seventeenth Day of September, 1991

*Attest:*

HARRY F. MANBECK, JR.

*Attesting Officer*

*Commissioner of Patents and Trademarks*